US005909964A

United States Patent [19]

Johns

[11] Patent Number: 5,909,964

[45] Date of Patent: Jun. 8, 1999

[54] CREASE IRONING APPARATUS

[76] Inventor: David G. Johns, 6242 S. Port Dr., Flowery Branch, Ga. 30542

[21] Appl. No.: 09/040,608

[22] Filed: Mar. 18, 1998

[51] Int. Cl.[6] ..... D06F 71/30; D06F 85/00

[52] U.S. Cl. ..... 38/1 B; 38/103; 38/104; 38/69

[58] Field of Search ..... 38/12, 64, 1 B, 38/69, 103, 104, 108, 135, 138, 144; 269/55, 95, 97

[56] References Cited

U.S. PATENT DOCUMENTS

| | | | |
|---|---|---|---|
| 582,129 | 5/1897 | Jones | 38/108 |
| 863,150 | 8/1907 | Busch et al. | 38/135 |
| 1,288,869 | 6/1918 | Anderson | 38/103 |
| 2,554,983 | 5/1951 | Hedges | 38/106 |
| 2,729,906 | 1/1956 | Kleinsorge | 38/135 |
| 2,869,259 | 1/1959 | Hipp | 38/106 |
| 2,888,759 | 6/1959 | Vennen | 38/135 |
| 3,316,667 | 5/1967 | Harny | 38/108 |
| 4,745,694 | 5/1988 | Skopek | 38/103 |
| 4,779,365 | 10/1988 | Theeteh | 38/135 |
| 5,016,367 | 5/1991 | Breen et al. | 38/135 |
| 5,335,431 | 8/1994 | Ohnishi | 38/18 |

*Primary Examiner*—Ismael Izaguirre
*Attorney, Agent, or Firm*—Joseph N. Breaux

[57] ABSTRACT

A crease ironing apparatus is provided that is adaptable to be either attached to an existing ironing board or as a stand alone apparatus, wherein the apparatus includes two elongated members, while one member's longitudinal transverse cross section resembles a U forming a longitudinal trough and the other member's longitudinal transverse cross section is dimensioned to fit within the trough of the other member along with the fabric to be clamped while the two members are hingedly secured at one end allowing the two members to scissor together or apart to receive fabric to be clamped while further comprising a means for securing the two members in the clamping position and if desired a means for clamping the device to an existing ironing board.

6 Claims, 3 Drawing Sheets

CREASE IRONING APPARATUS

TECHNICAL FIELD

The present invention relates to devices and methods for ironing clothes and more particularly to devices and methods for ironing clothes that provides a means for ironing straight and or aligned creases in clothing articles wherein a section of fabric is clamped in place while a crease may be ironed in alignment with the clamped section thus providing an efficient means for ironing straight creases in trouser legs or shirt sleeves.

BACKGROUND ART

Hand ironing creases that are both straight and aligned with seams in trouser legs, shirt sleeves and skirts is extremely difficult. The problem encountered by those attempting to iron straight creases arises from the difficulty of securing the garment in position with one hand while ironing with the other. Securing the garment usually takes more than one hand especially when long creases such as trouser legs are attempted to be ironed. The present invention solves this problem by securing the garment in position by clamping both sections of fabric forming the crease in alignment while the crease is ironed. The crease ironing apparatus is provided as an ironing board attachment which is either conveniently clamped to an ironing board or not clamped as an independent device which allows the entire garment to be moved around while the device clamps fabric sections in alignment for creases to be ironed.

Numerous prior art devices have been patented for attaching to an ironing board to improve ironing for certain garments or conditions. Breen et al, U.S. Pat. No. 5,016,367 discloses an ironing board with two swingable board extensions for assisting in ironing all portions of trouser legs. Theeten, U.S. Pat. No. 4,779,365 discloses an ironing board with two parallel ironing surfaces useful for ironing clothes of varying dimensions. Vennen, U.S. Pat. No. 2,888,759 discloses an ironing board with a built-in midget board permitting the ironing of various items which are ordinarily too difficult to iron on a large ironing surface. Hipp, U.S. Pat. No. 2,869,259 discloses an ironing board attachment comprising an apron sling adapted transversely under the ironing board to receive clothes to be iron keeping the clothes off the floor. Kleinsorge, U.S. Pat. No. 2,729,906 discloses an ironing device attachable to an ironing board which is adapted for ironing garments having curved surfaces. And finally, Hedges, U.S. Pat. No. 2,554,983 discloses an ironing board attachment which includes an adjustable support means adjacent to the side of the ironing board which can be extended in an outward and upward direction to support large articles when ironing such as sheets, and curtains. These prior devices in the field of art concerned herein are extremely useful, however these prior devices do not provide an ironing board attachment means for ironing straight and aligned creases in garments.

GENERAL SUMMARY DISCUSSION OF INVENTION

It is thus an object of the invention to provide a Crease Ironing Apparatus that is adaptable for securing garment fabric so that creases in the fabric are held straight and in alignment while ironing the creases.

It is still a further object of the invention to provide a Crease Ironing Apparatus that is quickly clamped to an existing ironing board and which provides an elongated fabric clamping means for aligning and securing fabric in position for ironing straight and aligned creases.

It is still a further object of the invention to provide a Crease Ironing Apparatus that includes elongated clamping members long enough to clamp trouser leg fabric seams together thereby aligning the trouser leg creases to be ironed providing a means for ironing straight creases which are aligned with the trouser seams.

It is still another object of the present invention to provide a Crease Ironing Apparatus that includes two hinged elongated clamping members wherein one member includes a longitudinally elongated trough which receives a longitudinal section of the other member and the fabric to be clamped, while the two members further include a means for locking the clamping members in a clamped position.

Accordingly, a Crease Ironing Apparatus is provided that is adaptable to be either attached to an existing ironing board or as a stand alone apparatus, wherein the apparatus includes two elongated members, while one member's longitudinal transverse cross section resembles a U and the other member's longitudinal transverse cross section is dimensioned to fit within the U of the other member along with two layers of fabric to be clamped while the two members are hingedly secured at one end allowing the two members to scissor together or apart to receive fabric to be clamped while further comprising a means for securing the two members in the clamping position and if desired a means for clamping the device to an existing ironing board.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the preceding description that the crease ironing apparatus is adaptable to be either mounted to an existing ironing board with a clamping means or can be used as a stand alone fabric clamping apparatus which helps align fabric so that creases can be ironed which are straight and if desired aligned with the clothing seam. The apparatus comprises two elongated members which are hingedly secured on one end, while one member has a cross section which is U shaped and the other member is dimensioned to be received within the legs of the U shaped member along with two layers of fabric to be clamped into position for ironing. The elongated members are long enough to clamp the length of trouser legs so that the trouser leg seams can be quickly ironed in alignment with the seams. The device is first opened, by a scissoring motion, by pivoting the members along the hinge, the seams of the trouser legs are then placed into the trough formed by the U shaped member and the other elongated member is brought back to a closed position within the U shaped member trough and on top of the fabric and seams, a clamp locking means provides a means to lock the elongated members into place. The clamped trouser seams now provide a crease aligned with the seam which are then ironed. The crease ironing apparatus is then removed by opening the members leaving an ironed crease which is aligned with the seams and which is straight down the length of the trouser legs.

Figure 1:
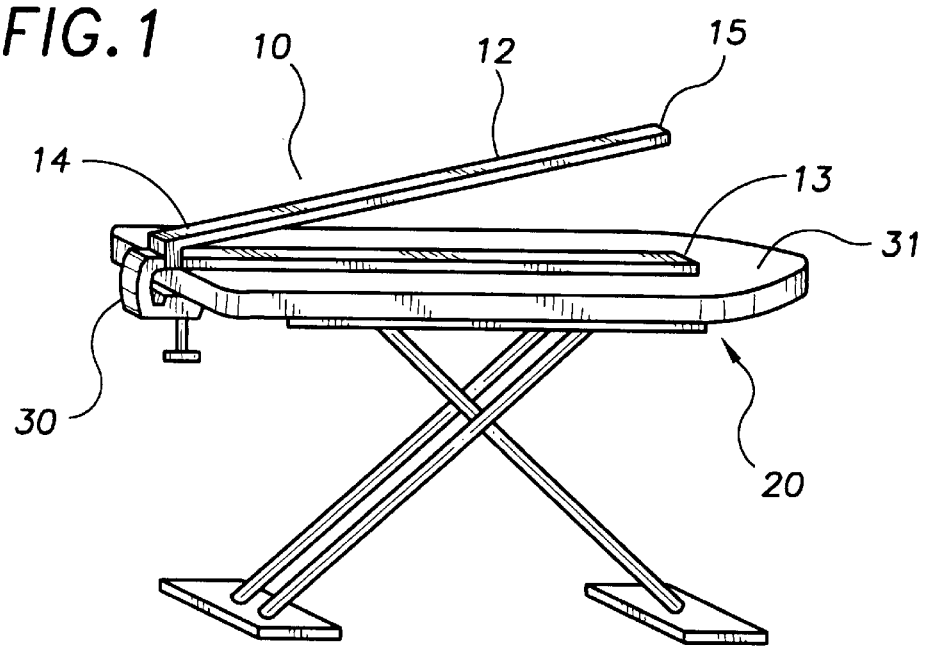
FIG. 1 is a typical ironing board illustrating the apparatus clamped to the ironing board in an open position ready to receive fabric to be clamped.
Figure 2:
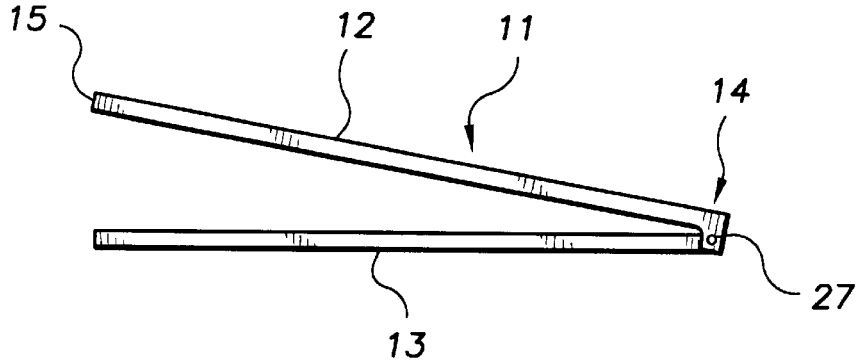
FIG. 2 is a side view of the apparatus with the elongated members in an open position without a ironing board clamping means.
Figure 3:
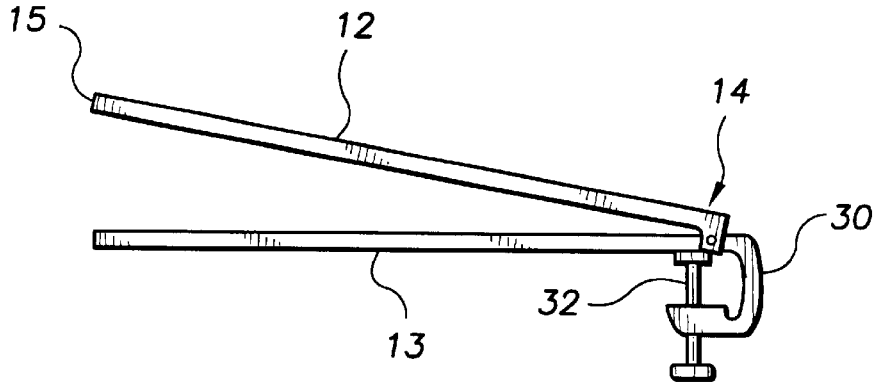
FIG. 3 is a side view of the apparatus with the elongated members in an open position with an ironing board clamping means.
Figure 4:
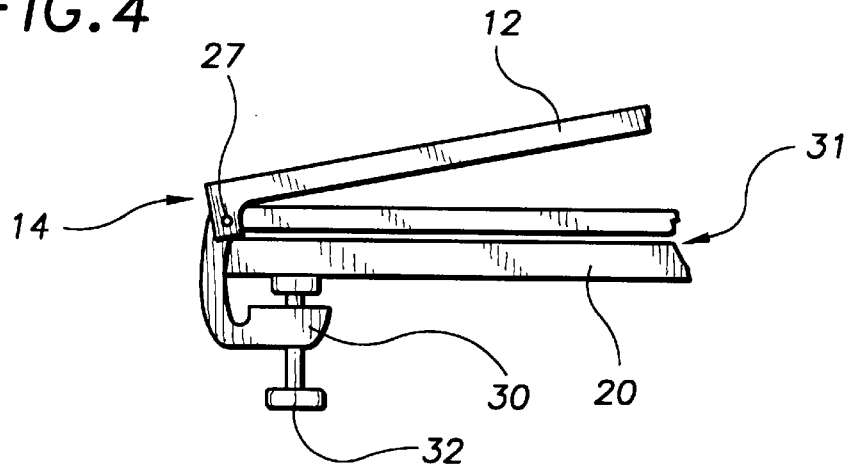
FIG. 4 is a closeup side view of the apparatus hinged end including an ironing board clamping means.
Figure 5:
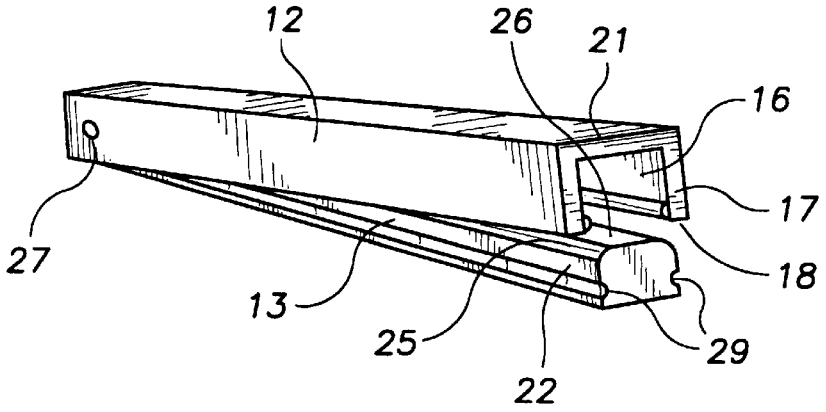
FIG. 5 is an isometric view of the apparatus elongated members in a partially closed position.
Figure 6:
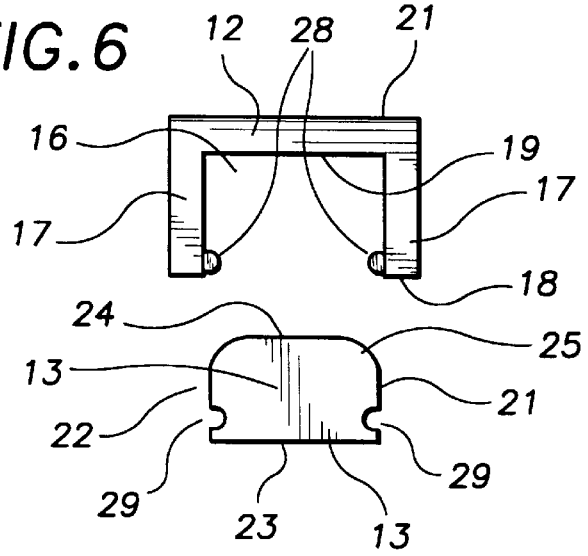
FIG. 6 is a longitudinal transverse cross section of the two elongated members in an opened position.

Referring to the figures, FIG. 1 illustrates the crease ironing apparatus 10 clamped to an existing ironing board 20. The crease ironing apparatus 10 may be provided with an ironing board "C" clamping means 30 as illustrated in FIG. 3, or as a stand alone crease ironing apparatus 11 as illustrated in FIG. 2. The apparatus 10 comprises two elongated members, while one elongated member is an elongated troughed member 12 having a cross section resembling a U, while the other elongated member is an elongated rectangular member 13 which has a cross section resembling a rectangle. The elongated members 12 and 13 have two ends, one end is a hinged end 14 and the other end is a head end 15. The members 12 and 13 are preferably about thirty to about thirty six inches long allowing the full length of trouser leg seams 41 to be clamped allowing the trouser leg seams 42 to be ironed straightly and in alignment with the seams 41. The troughed member 12 includes a trough 16 with two elongated trough sides 17, an elongated trough top edge 18, an elongated bottom 19 and an exterior bottom surface 21. The exterior bottom surface 21 is preferable about one inch wide, while the height of the sides 17 are about seven eighths of an inch. The rectangular member 13 includes elongated sides 22, an elongated bottom surface 23 and an elongated top surface 24, two rounded top edges 25 adjacent to the top surface 24 which provides for fabric space when the members are moved to a closed clamping position. The rectangular member 13 is preferable about three eighths inch high and about three quarter inches wide. Both elongated members are preferably constructed of a lightweight durable material such as aluminum, or high density plastic. Furthermore, the elongated top surface 24 of the rectangular member 13 preferably includes a frictional fabric engagement surface 26, which provides a gripping surface for assuring that once the fabric has been clamped between the elongated members it will not slip out of place prior to ironing the creases. The frictional surface may be a knurled or textured surface which may be formed as part of the construction material for the rectangular member, or it may be etched into the surface.

The elongated members are preferably hinged at one end by use of a pin hinge 27. The rectangular elongated member 13 is positioned within the trough 16 of the elongated troughed member 12 so that as the rectangular member 13 rotates about the hinge 27 it moves into or out of the trough 16. The elongated members also includes a means for securing the clamping of the fabric and locking the elongated members in a closed position. The clamp securing means includes a pair of elongated ridges 28 positioned on the elongated side 17 of the troughed member 12, which extend longitudinally the length of the troughed member 12. The ridges 28 are preferably located near the top edge 18 of the elongated troughed member 12. The camping means further includes a pair of elongated notches 29 extending longitudinally the length of the rectangular member 13 and positioned on the elongated sides 22 of the elongated member 13. The ridges 28 and the notches 29 are aligned so that when the elongated members are hingedly brought together to a closed position wherein the rectangular member is within the trough, the ridges 28 and notches 29 engage thereby locking them in a closed position, illustrated in FIG. 7. The elongated sides 17 of the troughed member 12 are biased to resist separation or widening of the trough opening 16, thereby further assuring the locking engagement of the ridges 28 within the notches 29.

A "C" clamping device 30 is provided for clamping the apparatus to the top surface 31 of an ironing board 20. The "C" clamp 30 is preferably formed as an integral part of the elongated rectangular member 13 and an extension of the hinged end 14 of the rectangular member 13 and further extending from the bottom surface 23 of the rectangular member. The clamp 30 also includes a threaded tightening ram 32 for clamping the ironing board 20 between the rectangular member bottom surface 23 and the ram 32.

Figure 7:
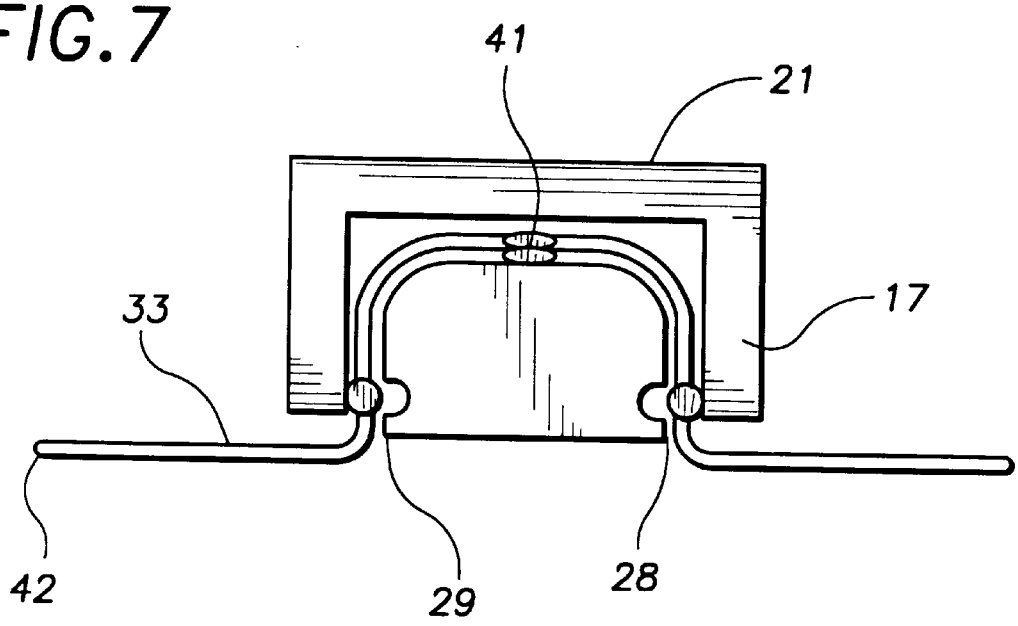
FIG. 7 is a longitudinal transverse cross section of the two elongated members in a closed clamping position with fabric and fabric seams clamped in the apparatus.
Figure 8:
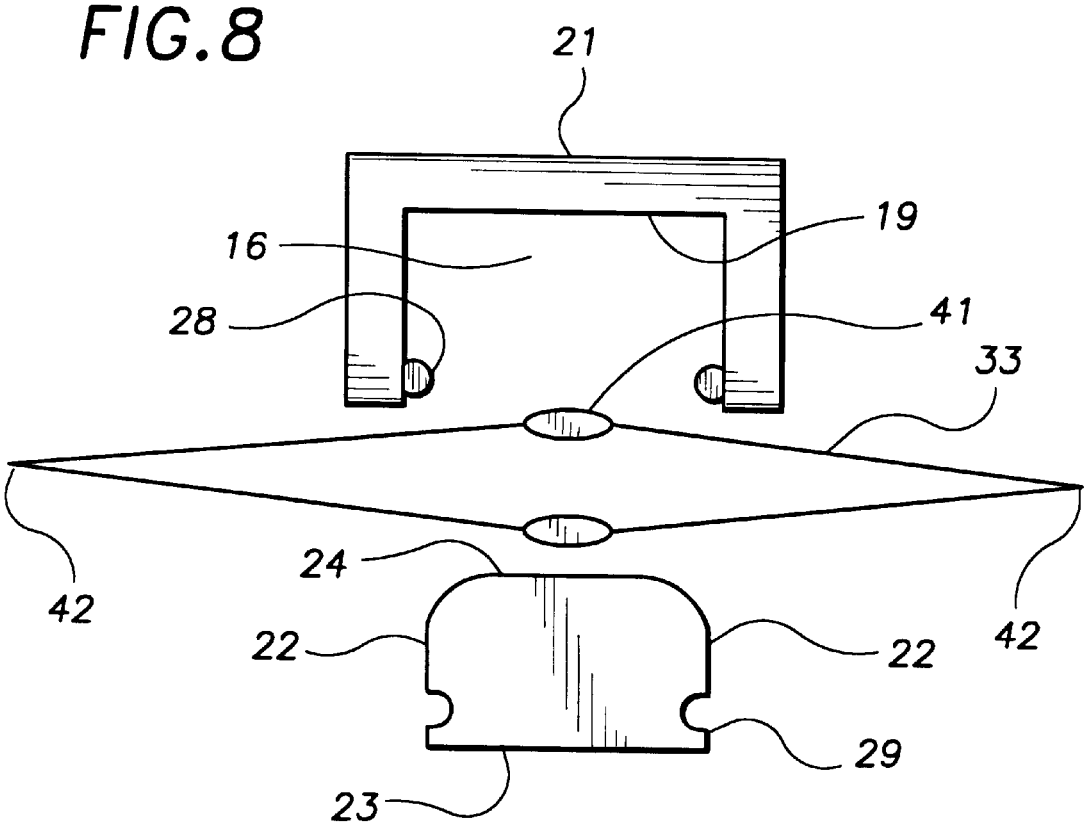
FIG. 8 is a longitudinal transverse cross section of the two elongated members in an open position with fabric and fabric seams in position before clamping the members together.

In use, fabric to be clamped 33 is positioned between the trough 16 and the rectangular member top surface 25 of an open apparatus. FIG. 8 illustrates a cross section of the open apparatus with a trouser leg 33 positioned within the open apparatus ready to be clamped into position prior to ironing the trouser leg crease 42. The trouser seams 41 are preferable aligned in the middle of the trough 16 prior to closing the apparatus. The elongated members are then brought together so that the rectangular member 13 is within the trough 16 of the elongated troughed member 12, and the members are urged toward the closed position until the clamping locking means snaps into engagement, as illustrated in FIG. 7. The trouser leg seams 41 are now clamped into position while creases 42 may now be ironed which create straight creases 42 that are in alignment with the clamped trouser leg seams 41. The apparatus may be used to iron straight creases in skirts, shirts and other articles of clothing.

It is noted that the embodiment of the Crease Ironing Apparatus described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Crease Ironing Apparatus useful for aligning and clamping fabric in a desired orientation providing a means for ironing straight creases, the apparatus comprising: a pair of elongated members each having two ends with one end of each member hingedly secured to the other, one elongated member includes an elongated trough section longitudinally positioned on the elongated member while a longitudinal transverse cross section of the member resembles a U, while the other elongated member is an extended rectangular member and has a longitudinal transverse cross section which resembles a rectangle and is dimensioned to be received along with fabric to be clamped within the elongated trough of the other elongated member, the hinged end of the elongated members allow a scissoring movement of the elongated members to a closed fabric clamping position wherein the elongated rectangular member moves into the elongated trough when the members are brought together thereby clamping fabric which has been placed between the rectangular member and the elongated trough, and an open position wherein the elongated rectangular member is scissored out of the elongated trough when the members are hingedly moved apart, and a fabric clamping securing means which means secures the rectangular elongated member in the elongated trough in the closed fabric clamping position when the two members are scissored together.

2. The Crease Ironing Apparatus of claim 1, wherein the rectangular elongated member further comprises: an elongated top surface, an elongated bottom surface, and two elongated side surfaces, further wherein said longitudinal transverse cross section resembles a rectangle with two rounded top edges adjacent to said top surface and further wherein said top surface comprises a frictional fabric engagement surface.

3. The Crease Ironing Apparatus of claim 2, wherein said fabric clamping securing means comprises: the elongated troughed member which further comprises two interior trough elongated sides with bottom edges near a bottom of the trough and top edges near a top of the trough and one elongated ridge on each interior trough elongated side positioned longitudinally on said trough sides and adjacent to said top edges, and wherein said rectangular elongated member sides further comprise an elongated notch positioned longitudinally on each elongated side surface and adjacent to the bottom surface of said rectangular elongated member and further wherein said elongated notches and elongated ridges are aligned so that when the elongated members are moved to a closed fabric clamping position the ridges move into the notches and are biased to remain in the notches.

4. The Crease Ironing Apparatus of claim 1 wherein the apparatus further comprises: an ironing board clamping means providing a means for securing the apparatus to a top surface of an ironing board which further comprises an extending "C" clamp member attached to said rectangular elongated member.

5. A Crease Ironing Apparatus useful for aligning and clamping fabric in a desired orientation providing a means for ironing straight creases, the apparatus comprising: a pair of elongated members each having two ends with one end of each member hingedly secured to the other, one elongated member includes an elongated trough section longitudinally positioned on the elongated member while a longitudinal transverse cross section of the member resembles a U, while the other elongated member is an extended rectangular member which includes an elongated top surface, an elongated bottom surface, and two elongated side surfaces and further wherein said longitudinal transverse cross section resembles a rectangle with two rounded top edges adjacent to said top surface and further wherein said top surface comprises a frictional fabric engagement surface and is dimensioned to be received along with fabric to be clamped within the elongated trough of the other elongated member, the hinged end of the elongated members allow a scissoring movement of the elongated members to a closed fabric clamping position wherein the elongated rectangular member moves into the elongated trough when the members are brought together thereby clamping fabric which has been placed between the rectangular member and the elongated trough, and an open position wherein the elongated rectangular member is scissored out of the elongated trough when the members are hingedly moved apart, and a fabric clamping securing means which comprises the elongated troughed member which further comprises two interior trough elongated sides with bottom edges near a bottom of the trough and top edges near a top of the trough and one elongated ridge on each interior trough elongated side positioned longitudinally on said trough sides and adjacent to said top edges, and wherein said rectangular elongated member sides further comprise an elongated notch positioned longitudinally on each elongated side surface and adjacent to the bottom surface of said rectangular elongated member and further wherein said elongated notches and elongated ridges are aligned so that when the elongated members are moved to a closed fabric clamping position the ridges move into the notches and are biased to remain in the notches the apparatus further comprises an ironing board clamping means providing a means for securing the apparatus to a top surface of an ironing board which further comprises an extending C clamp member attached to said rectangular elongated member.

6. The Crease Ironing Apparatus of claim 5 wherein the apparatus further comprises: a pair of elongated members which are about 30 to about 36 inches long so that the members may be utilized to clamp a trouser's leg seams to facilitate ironing a trouser's leg creases in alignment with the seams.

* * * * *